US005353538A

United States Patent [19]

Hakedal et al.

[11] Patent Number: 5,353,538

[45] Date of Patent: Oct. 11, 1994

[54] RIFLE SLING

[76] Inventors: Jon Håkedal, Svend Foynsgt. 35, N-3100 Tønsberg; Egil Nystuen, Hjemsengvn. 89, N-3133 Duken, both of Norway

[21] Appl. No.: 177,436

[22] Filed: Jan. 5, 1994

Related U.S. Application Data

[63] Continuation of Ser. No. 22,139, Feb. 25, 1993, abandoned.

[30] Foreign Application Priority Data

Mar. 2, 1992 [NO] Norway ..... 920813

[51] Int. Cl.[5] ..... F41C 23/02

[52] U.S. Cl. ..... 42/85; 224/150; 224/913

[58] Field of Search ..... 42/85, 94; 24/2.5; 224/150, 913, 267

[56] References Cited

U.S. PATENT DOCUMENTS

| | | | |
|---|---|---|---|
| 1,446,058 | 2/1923 | Neilly | 224/150 |
| 2,112,577 | 3/1938 | Roberts | 42/85 |
| 2,116,618 | 5/1938 | Crockett | 42/85 |
| 2,357,363 | 9/1944 | Smith et al. | 224/150 |
| 2,446,197 | 8/1948 | Sloan | 224/150 |
| 2,463,107 | 3/1949 | Holroyd | 42/94 |
| 2,812,123 | 11/1957 | Girton | 224/150 |
| 2,857,701 | 10/1958 | Morrison | 42/85 |
| 2,933,843 | 4/1960 | McFeeter | 42/85 |
| 3,927,808 | 12/1975 | Steen | 42/94 |
| 5,040,324 | 8/1991 | Rivera et al. | 224/913 |
| 5,056,253 | 10/1991 | Willumsen | 42/85 |
| 5,082,155 | 1/1992 | Salvador | 224/150 |

FOREIGN PATENT DOCUMENTS

| | | | |
|---|---|---|---|
| 213445 | 2/1941 | Switzerland | 42/85 |

*Primary Examiner*—David Brown
*Attorney, Agent, or Firm*—Andrus, Sceales, Starke & Sawall

[57] ABSTRACT

A rifle sling for steadying the left arm of the shooter, comprises a length of band or strap material (1) which has an upper arm loop (8) at one end and a hand loop (6) at the other end, said loops being inter-connected by a middle portion. The upper arm loop (8) has a double portion extending between a tightening buckle (2) and an adjustment buckle (3). By using these buckles to adjust the length of the double portion, both the upper arm loop (8) and the middle portion of the sling can be adjusted to fit the shooter. The sling may be worn in a non-operable condition with the upper arm loop (8) tightened around the upper arm of the user and with the hand loop (6) tucked in under the upper arm loop. When assuming a shooting position, the user loosens the hand loop (6) and puts his four fingers through the loop, thus tensioning the middle portion of the sling and steadying his arm while the fore-end of the gun rests in his palm. Since the sling is at no time attached directly to the gun, the sling is particularly suitable for hunters.

22 Claims, 2 Drawing Sheets

RIFLE SLING

CROSS REFERENCE TO RELATED APPLICATION

This application is a continuation of application Ser. No. 08/022,139, filed Feb. 25, 1993, now abandoned.

The present invention relates to a rifle sling made of band or strap material, which in common shooting positions may form a steadying connection between the upper part and the lower part of the shooter's arm, comprising an upper arm loop which is adjustable for attachment about the upper arm of the shooter by the aid of a tightening buckle means, an end portion for cooperation with the outer part of the shooter's arm without being attached to the rifle, and a length adjustable middle portion interconnecting the upper arm loop and the end portion.

In rifle target shooting it is common to use a rifle sling, e.g. a so-called match sling, which is permanently connected at least to the fore-end of the rifle stock. Before the shooting position can be assumed, the sling must be attached to the upper arm of the user. This makes the match sling impractical and less suited for hunting and it is therefore in very little use among hunters.

From U.S. Pat. No. 2.463.107 a rifle sling is known which is of the type mentioned in the introductory paragraph and thus is designed to be worn by the shooter without being attached to the gun. However, this rifle sling has not found much use, probably among other reasons because the end portion which is to cooperate with the outer part of the shooter's arm is constituted by a cuff-like portion which is to be tightened about the user's wrist. The length adjustable middle portion of the sling may either be permanently attached to both the upper arm loop and the cuff-like part and be provided with a hook arrangement for shortening to the correct length when the shooting position is assumed, or it may be permanently attached to the upper arm loop only and be attached to the cuff-like part by means of a hook upon the bending of the arm to the shooting position. The cuff-like part may be difficult to get at quickly when the user is wearing usual hunting clothes, and in order to serve its purpose, it must be strapped so tightly around the user's wrist that it can be expected to provide discomfort when worn for an extended period, as is usually necessary in a hunting situation. Besides, this prior art rifle sling is expensive to manufacture due to its many different components and, i.a. due to the hook provided on its middle portion, it will easily get tangled in branches or the like.

This purpose of the present invention is to provide a rifle sling which is not encumbered by the above mentioned drawbacks and deficiencies and which therefore will be suitable also for hunting.

According to the invention, this is obtained by means of a rifle sling of the type mentioned by way of introduction, which is characterized in that said end portion comprises a hand loop for receiving the middle hand (metacarpus) of the shooter. With such a design it is avoided that parts of the sling have to be attached permanently to the user's hand, wrist or lower arm, the sling being attached exclusively to the upper arm of the user when in the non-operative condition.

According to an advantageous embodiment of the invention, the upper arm loop includes means for adjusting the length of the middle portion. Thus, the middle portion and the hand loop can be made entirely without buckles, hooks or the like that inadvertently could get caught and prevent effective use of the rifle strap.

According to a particularly advantageous embodiment of the invention, the upper arm loop comprises a double portion of the band or strap material, said double portion extending between the tightening buckle means and an adjustment buckle means, the length of said double portion being adjustable by the aid of said adjustment buckle means. By adjusting the length of the double portion of the upper arm loop, the length of the middle portion connecting the upper arm loop to the hand loop may be regulated in order to adapt the rifle strap to the hunter irrespective of his arm length or preferred shooting position. These features and the fact that it may be made of a single piece of band or strap material, makes the rifle sling very simple to use and inexpensive to manufacture.

Further advantageous features of the invention are recited in the dependent claims 14–22.

For better understanding of the invention, it will be described in greater detail with reference tot he exemplifying embodiment shown in the appended drawings, wherein.

Figure 1:
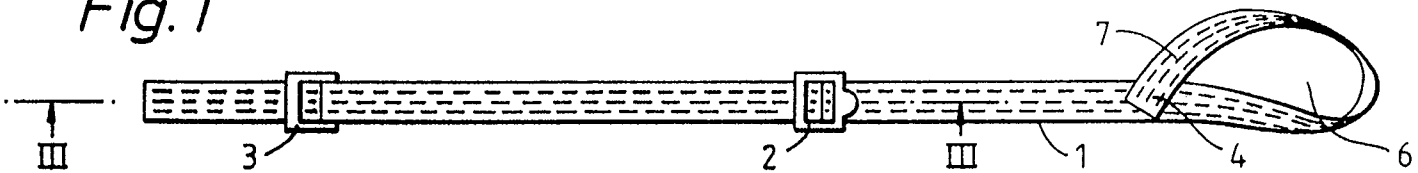
FIG. 1 is a plan view of a rifle sling according to the invention.

The rifle sling shown in the figures comprises a band 1, which may be made of polyester and which on one side is provided with a friction layer 7 in the form of interwoven rubber threads extending for the entire length of the band and also covering its entire width. The opposite side of the band 1 is without friction layer and is therefore smooth.

Together with a tightening buckle 2 and an adjustment buckle 3, the band 1 forms an upper arm loop 8. As will be apparent from FIG. 1 and 3, the tightening buckle 2 is constituted by two side parts and four transverse parts, one of which is provided with a gripping lip for facilitating the use of the buckle. Between the transverse parts slots are formed, through which the band 1 may be threaded. Similarly, the adjustment buckle 3 consists of two side parts and three transverse parts with slots therebetween.

One end of the band 1 is threaded around one of the outer transverse parts of the adjustment buckle 3 and is attached to the band by means of sewing 5, welding or the like. From that point the band 1 runs around one of the middle transverse parts of the tightening buckle 2, back to the adjustment buckle 3 and around its middle transverse part, whereupon the band again runs to the tightening buckle 2 and over the second of its middle transverse parts. From this point the band runs as a middle portion up to a hand loop 6, which is formed by turning the other end of the band 1 back while twisting it one half of a turn and attaching it to the band in a crossing point 4 by means of sewing or other suitable means. Preferably, the band 1 and its said other end form an angle of about 50° between them at the crossing point 4. Due to the twisting of the end of the band, a smooth side of the band will be lying against a side having the friction layer 7 at the crossing point 4. The twisting is made in such a direction that the smooth side of the band 1 faces inwardly in the hand loop 6.

The buckles 2 and 3 may advantageously be made of a plastic material. However, it will be understood that for both the band and buckles other materials or combinations of materials may be used, e.g. leather bands or straps, metal buckles, Velcro locks and so on.

In using the rifle sling, the upper arm loop 8 is brought up and about the upper arm and is attached by means of the tightening buckle 2 in such a manner that the hand loop 6 faces forwards and outwardly from the body. If, when the sling is used for the first time, it is necessary to adjust the length of the middle portion between the upper arm loop 8 and the hand loop 6, this is done by extending or shortening the double band portion between the tightening buckle 2 and the adjustment buckle 3, thereby including a larger or smaller part of the total length of the band 1 in the double portion.

Figure 4:
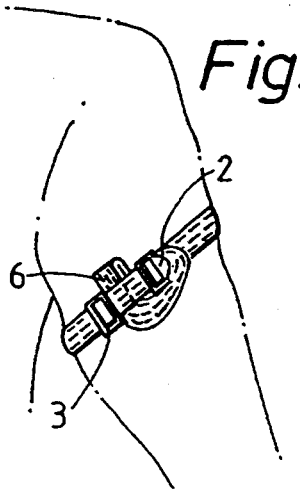
FIG. 4 shows the rifle sling strapped in place in carrying position.

In the non-operative position of the rifle sling, the middle portion and the hand loop may be wrapped around the upper arm and inserted under the upper arm loop in order to be out of the way, as shown in FIG. 4.

Figure 5:
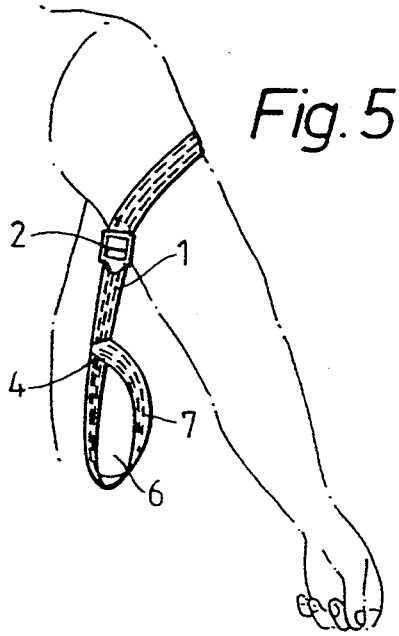
FIG. 5 shows the rifle sling ready for use.
Figure 6:
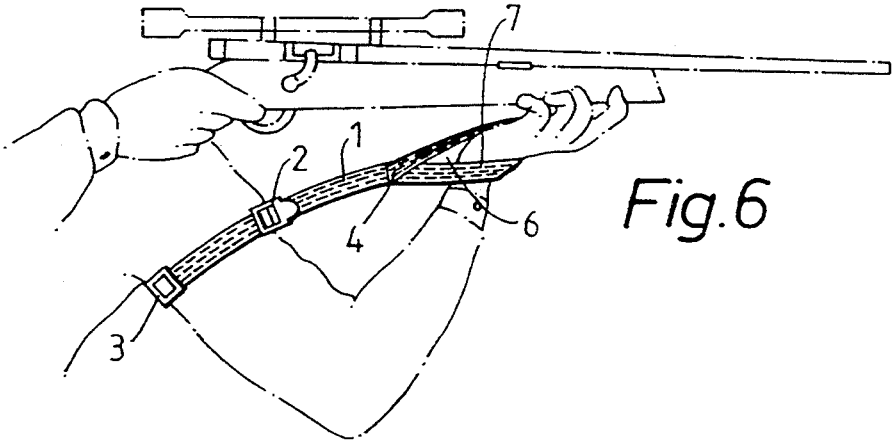
FIG. 6 shows the rifle sling in shooting position.

When assuming the shooting position, the hand loop and the middle portion are pulled free of the upper arm loop so that they will be positioned for instance as shown in FIG. 5. Subsequently, the middle hand is introduced into the hand loop 6 so that the middle portion is tensioned, whereupon the fore-end of the gun is placed in the hand as shown in FIG. 6. The friction layer 7 will face outwards on the hand loop 6 so that good friction is obtained against the fore-end even if the user should wear a mitten or glove.

Figure 2:
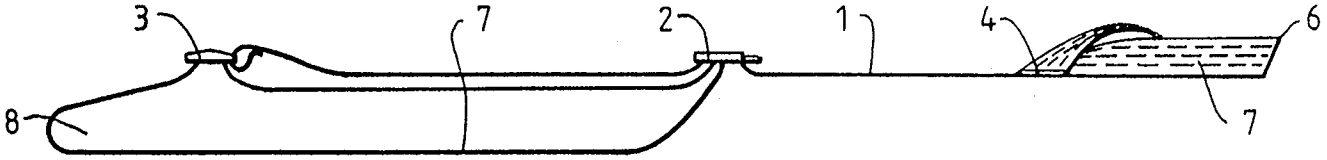
FIG. 2 is a side view of the rifle sling in FIG. 1.
Figure 3:
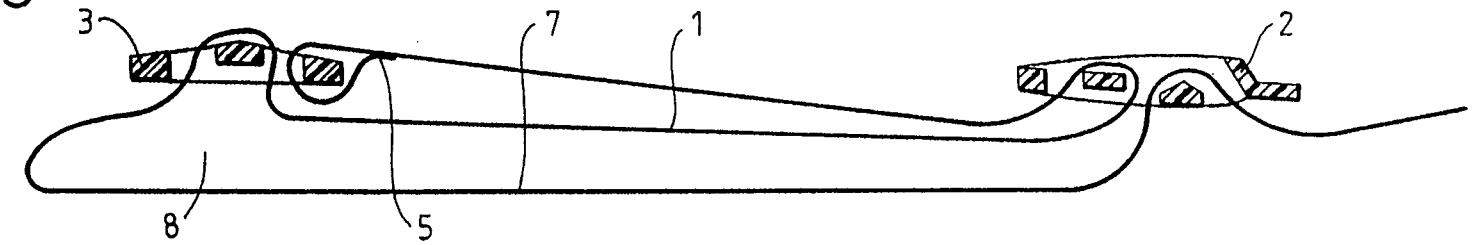
FIG. 3 is a section along the line III—III in FIG. 1 at a larger scale.

As shown in FIGS. 1–3, the friction layer 7 faces inwards in the upper arm loop 8. The loop will therefore stay in place on the upper arm without uncomfortable tightening. The friction layer 7 also reduces the tendency for the band 1 to slip in the tightening buckle 2.

The rifle sling can easily be converted to a carrying sling for deer or similar game. For instance, the hand loop and middle portion of the sling may be converted to a running loop which is tightened about the forelegs of the deer. The upper arm loop 8 is wrapped around the hind legs and tightened by means of the tightening buckle 2. The deer may then be carried over the shoulder by means of the middle portion of the sling.

The rifle sling may also be used to suspend a deer in order to ease skinning and butchering. This is done by attaching one end of the sling at suitable height, e.g. to a branch or the like. Subsequently, the animal is lifted and one of its hind legs is attached to the other end of the sling.

While the invention has been described above in the form of a preferred embodiment, it is quite apparent that variations may be made both in the choice of materials and the arrangement of other elements without parting from the spirit and scope of the invention as defined in the following claims.

We claim:

1. A rifle sling made of band or strap material (1), which in common shooting positions may form a steadying connection between the upper part and the lower part of the shooter's arm, comprising an upper arm loop (8) which is adjustable for attachment about the upper arm of the shooter by the aid of tightening buckle means (2), an end portion (6) for cooperation with the outer part of the shooter's arm, and a length adjustable middle portion inter-connecting the upper arm loop (8) and the end portion (6), characterized in that the upper arm loop (8) comprises a double portion of the band or strap material (1), said double portion extending between the tightening buckle means (2) and adjustment buckle means (3), the length of said double portion being adjustable by the aid of said adjustment buckle means (3), and in that said end portion comprises a hand loop (6) for receiving the middle hand of the shooter.

2. A rifle sling according to claim 1, characterized in that the tightening buckle means (2) comprises two side parts and four transverse parts with slots therebetween, in that the adjustment buckle means (3) comprises two side parts and three transverse parts with slots therebetween, in that one end of the band or strap material (1) is threaded around one of the outer transverse parts of the adjustment buckle means (3) and is attached to said material by means of sewing (5) or other suitable means, in that said material (1) further extends around one of the middle transverse parts of the tightening buckle means (2) back to the adjustment buckle means (3) and around its middle transverse part, whereupon the material (1) again extends to the tightening buckle means (2) and over the second of its middle transverse parts.

3. A rifle sling according to claim 1 characterized in that one side of the band or strap material (1) is provided with a friction layer (7).

4. A rifle sling according to claim 1, characterized in that the band or strap material (1) is constituted by leather.

5. A rifle sling according to claim 1, characterized in that the tightening buckle means (2) and the adjustment buckle means (3) consist of plastic material.

6. A rifle sling according to claim 1, characterized in that the band or strap material (1) is constituted by a single length of said material.

7. A rifle sling according to claim 1, characterized in that the band or strap material (1) consists of woven polyester.

8. A rifle sling according to claim 7, characterized in that the band or strap material (1) on one side is provided with a friction layer (7) in the form of interwoven rubber threads.

9. A rifle sling according to claim 1, characterized in that the hand loop (6) is formed by one end of the band or strap material (1) being turned back and simultaneously twisted one half of a turn and attached to said material at a crossing point (4).

10. A rifle sling according to claim 9, characterized in that an angle of about 50° is formed between the band or strap material (1) and its end at said crossing point (4).

11. A rifle sling made of band or strap material (1), which in common shooting positions may form a steadying connection between the upper part and the lower part of the shooter's arm, comprising an upper arm loop (8) which is adjustable for attachment about the upper arm of the shooter by the aid of tightening buckle means (2), an end portion (6) for cooperation with the outer part of the shooter's arm without being attached to the rifle, and a length adjustable middle portion inter-connecting the upper arm loop (8) and the end portion (6), characterized in that said end portion comprises a hand loop (6) for receiving the middle hand of the shooter.

12. A rifle sling according to claim 11, characterized in that one side of the band or strap material (1) is provided with a friction layer (7).

13. A rifle sling according to claim 11, characterized in that the band or strap material (1) is constituted by leather.

14. A rifle sling according to claim 11, characterized in that the tightening buckle means (2) and the adjustment buckle means (3) consist of plastic material.

15. A rifle sling according to claim 11, characterized in that the band or strap material (1) is constituted by a single length of said material.

16. A rifle sling according to claim 11, characterized in that the band or strap material (1) consists of woven polyester.

17. A rifle sling according to claim 16, characterized in that the band or strap material (1) on one side is provided with a friction layer (7) in the form of interwoven rubber threads.

18. A rifle sling according to claim 11, characterized in that the hand loop (6) is formed by one end of the band or strap material (1) being turned back and simultaneously twisted one half of a turn and attached to said material at a crossing point (4).

19. A rifle sling according to claim 18, characterized in that an angle of about 50° is formed between the band or strap material (1) and its end at said crossing point (4).

20. A rifle sling according to claim 11, characterized in that said upper arm loop (8) includes means for regulating the length of said middle portion.

21. A rifle sling according to claim 20, characterized in that said means included in the upper arm loop (8) comprises a double portion of the band or strap material (1), said double portion extending between the tightening buckle means (2) and adjustment buckle means (3), the length of said double portion being adjustable by the aid of said adjustable buckle means (3).

22. A rifle sling according to claim 21, characterized in that the tightening buckle means (2) comprises two side parts and four transverse parts with slots therebetween, in that the adjustment buckle means (3) comprises two side parts and three transverse parts with slots therebetween, in that one end of the band or strap material (1) is threaded around one of the outer transverse parts of the adjustment buckle means (3) and is attached to said material by means of sewing (5) or other suitable means, in that said material (1) further extends around one of the middle transverse parts of the tightening buckle means (2) back to the adjustment buckle means (3) and around its middle transverse part, whereupon the material (1) again extends to the tightening buckle means (2) and over the second of its middle transverse parts.

* * * * *